US007431566B2

(12) United States Patent
Gray et al.

(10) Patent No.: US 7,431,566 B2
(45) Date of Patent: Oct. 7, 2008

(54) EROSION RESISTANT COATINGS AND METHODS THEREOF

(75) Inventors: Dennis Michael Gray, Delanson, NY (US); Krishnamurthy Anand, Bangalore (IN); Warren Arthur Nelson, Clifton Park, NY (US); Hans Aunemo, Oslo (NO); Alain Demers, Lachine (CA); Olav Rommetveit, Raade (NO)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/546,861

(22) Filed: Oct. 12, 2006

(65) Prior Publication Data

US 2007/0031702 A1 Feb. 8, 2007

Related U.S. Application Data

(62) Division of application No. 10/749,420, filed on Dec. 31, 2003, now Pat. No. 7,141,110.

(60) Provisional application No. 60/524,098, filed on Nov. 21, 2003.

(51) Int. Cl.
*F03B 3/06* (2006.01)

(52) U.S. Cl. ..... 416/241 R; 416/241 B; 428/325; 428/334; 428/469; 428/698

(58) Field of Classification Search ..... 428/698, 428/325, 334, 469; 416/241 R, 241 B
See application file for complete search history.

(56) References Cited

U.S. PATENT DOCUMENTS

| | | | |
|---|---|---|---|
| 4,439,237 | A | 3/1984 | Kuminitsu et al. |
| 4,925,626 | A | 5/1990 | Anand et al. |
| 5,102,452 | A | 4/1992 | Taskinen et al. |
| 5,206,083 | A | 4/1993 | Raj et al. |
| 5,230,755 | A | 7/1993 | Pierantoni et al. |
| 5,271,965 | A | 12/1993 | Browning |
| 5,419,976 | A | 5/1995 | Dulin |
| 5,702,769 | A | 12/1997 | Peters |
| 5,759,216 | A | 6/1998 | Kanada et al. |
| 5,932,293 | A | 8/1999 | Belashchenko et al. |

(Continued)

FOREIGN PATENT DOCUMENTS

DE 100 61 749A1 A1 6/2002

(Continued)

OTHER PUBLICATIONS

International Search Report for International Application PCT/US2004/034931 filed Oct. 21, 2004.

(Continued)

*Primary Examiner*—Archene Turner
(74) *Attorney, Agent, or Firm*—Cantor Colburn LLP

(57) ABSTRACT

Erosion resistant coating processes and material improvements for line-of-sight applications. The erosion resistant coating composition includes nanostructured grains of tungsten carbide (WC) and/or submicron sized grains of WC embedded into a cobalt chromium (CoCr) binder matrix. A high velocity air fuel thermal spray process (HVAF) is used to create thick coatings in excess of about 500 microns with high percentages of primary carbide for longer life better erosion resistant coatings. These materials and processes are especially suited for hydroelectric turbine components.

8 Claims, 5 Drawing Sheets

U.S. PATENT DOCUMENTS

| | | | |
|---|---|---|---|
| 6,004,372 | A | 12/1999 | Quets |
| 6,245,390 | B1 | 6/2001 | Baranovski et al. |
| 6,365,274 | B1 | 4/2002 | Scheckenbach et al. |
| 6,513,728 | B1 | 2/2003 | Hughes et al. |
| 6,562,480 | B1 | 5/2003 | Stong et al. |
| 6,884,205 | B2 | 4/2005 | VanNoy et al. |
| 2002/0064667 | A1 | 5/2002 | Scheckenbach et al. |

FOREIGN PATENT DOCUMENTS

| | | | |
|---|---|---|---|
| EP | 0 224 827 | B1 | 10/1987 |
| EP | 0 687 746 | A1 | 6/1995 |
| EP | 1 111 089 | | 6/2001 |
| EP | 1 217 095 | A1 | 6/2002 |
| EP | 1 167 564 | A1 | 10/2006 |
| GB | 2 024 260 | A | 9/1980 |
| GB | 2 276 886 | A | 10/1994 |
| JP | 6 305 7789 | | 3/1988 |
| WO | WO 98 24576 | | 11/1998 |
| WO | WO 01 92601 | A1 | 6/2001 |

OTHER PUBLICATIONS

A. Karimi et al., Hydroabrasive Wear Behaviour of High Velocity Oxyfuel Thermally Sprayed WC-M Coatings, Surface and Coating Technology, 62 (1993) 493-498.

A. Karimi et al., Microstructure and Hydroabrasive Wear Behaviour of High Velocity Oxy-Fuel Thermally Sprayed WC-Co(Cr) Coatings, Surface and Technology, 57 (1993) 81-89.

S. Siegmann et al., Thermally Sprayed Wear Resistant Coatings With Nanostructured Hard Phases, Journal of thermal Spray Technology, vol. 13(1) Mar. 2004 37-43.

JP 08-253877; Date of Publication of Application: Jan. 10, 1996; Patent Abstracts of Japan (2 pgs).

Lee et al., A Study on the Mechanism of Formation of Electrocodeposited Ni-Diamond Coatings, Surface and Coatings Technology 148 (2001) 234-240.

Guan et al., Ni-Diamond Interactions, Materials Chemistry and Physics 46 (1996) 230-232.

Horlock et al., Thermally Sprayed Ni(Cr)—TiB2 Coatings Using Powder Produced by Self-Propagating High Temperature Synthesis: Microstructure and Abrasive Wear Behaviour, Materials Science and Engineering A336 (2002) 88-98.

Sikder et al., Surface Engineering of Metal-Diamond Composite Coatings on Steel Substrates Using Chemical Vapour Deposition and Electroplating Routes, Surface and Coatings Technology 114 (1999) 230-234.

Sikder et al., Chemical Vapour Deposition of Diamond on Stainless Steel: The Effect of Ni-Diamond Composite Coated Buffer Layer, Diamond and Related Materials 7 (1998) 1010-1013.

G. Meaden et al., Laser Cutting of Diamond Fibres and Diamond Fibre/Titanium Metal Matrix Composites, Diamond and Related Materials 5 (1996) 825-828.

Dai et al., Effects of Rare Earth and Sintering Temperature on the Transverse Rupture Strength of Fe-Based Diamond Composites, Journal of Materials Processing Technology 129 (2002) 427-430.

Reddy et al., A Study on the Wear Resistance of Electroless Ni-P/Diamond Composite Coatings, Wear 239 (2000) 111-116.

Ian Meredith, The Wear Resistant Design Ad Rebuild of the Ramgipo Francis Turbines, 10th HPEE Conference, May 19-24, 2002 Snowy Hidro AUS (19 pages).

Malcolm et al., Ashes to Ashes?, Australasia Rangipo Rebuild, International Water Power & Dam Construction Feb. 1997 (3 pgs).

Alec van Rossen, Refurbishing and Modifying Rangipo Hydro Turbines—To Survive Volcanic Ash in the Waterway, URHP, Montreal, 1997 (10 pgs).

EROSION RESISTANT COATINGS AND METHODS THEREOF

CROSS REFERENCE TO RELATED APPLICATIONS

This application is a divisional of U.S. application Ser. No. 10/749,420 filed Dec. 31, 2003 now U.S. Pat. No. 7,141,110 which claims the benefits of U.S. Provisional Patent Application Ser. No. 60/524,098 filed Nov. 21, 2003, which is fully incorporated herein by reference.

BACKGROUND

The present disclosure generally relates to coating methods and compositions for turbine components. These coatings and processes are especially suitable for hydroelectric turbine components, which exhibit improved silt erosion resistance from the coating.

Components are used in a wide variety of industrial applications under a diverse set of operating conditions. In many cases, the components are provided with coatings that impart various characteristics, such as corrosion resistance, heat resistance, oxidation resistance, wear resistance, erosion resistance, and the like.

Erosion-resistant coatings are frequently used on hydroelectric turbine components, and in particular, the runner and the guide vanes, for Francis-type turbines, and the runners, needles, and seats for Pelton-type turbines, as well as various other components that are prone to silt erosion. Erosion of these components generally occurs by impingement of silt (sand in the water) and particles contained therein (e.g., $SiO_2$, $Al_2O_3$, $Fe_2O_3$, MgO, CaO, clays, volcanic ash, and the like) that are carried by moving bodies of water. Existing base materials for hydroelectric turbine components such as martensitic stainless steels do not have adequate erosion resistance under these conditions. For example, hydroelectric turbine components when exposed to silt in the rivers that exceed 1 kg of silt per cubic meter of water have been found to undergo significant erosion. This problem can be particularly severe in Asia and South America where the silt content during the rainy season can exceed 50 kg of silt per cubic meter of water. The severe erosion that results damages the turbine components causing frequent maintenance related shutdowns, loss of operating efficiencies, and the need to replace various components on a regular basis.

In order to avoid erosion problems, some power stations are configured to shut down when the silt content reaches a predetermined level to prevent further erosion. Oftentimes, the predetermined level of silt is set at 5 kg of silt per cubic meter of water. In addition to shutting down the power stations, various anti-erosion coatings have been developed to mitigate erosion. Such coatings include ceramic coatings of alumina, titania, chromia, and the like; alloys of refractory metals, e.g., WC-CoCr coatings; WC-Co, WC-CoCr+NiCrBSi coatings; carbides; nitrides; borides; or elastomeric coatings. However, current compositions of the above noted materials and processes used to apply them generally yield coatings that are not totally effective during prolonged exposure to silt.

Current erosion resistant coatings are usually applied by thermal spray techniques, such as air plasma spray (APS), and high velocity oxy-fuel (HVOF). One limitation to current thermal spray processes is the limited coating thicknesses available due to high residual stress that results as thickness is increased by these methods. As a result, the final coating is relatively thin and fails to provide prolonged protection of the turbine component. Other limitations of these thermal spray processes are the oxidation and decomposition of the powder feed or wire feed stock during the coating process that form the anti-erosion coating, which can affect the overall quality of the finished coating. For example, present thermal spray processes such as plasma spray, wire spray, and HVOF are currently used for coating turbine components. These thermal spray processes generally leave the resulting coating with relatively high porosity, high oxide levels, and/or tends to decarborize primary carbides, if present in the coating. All of these factors have significant deleterious effects at reducing erosion resistance of the coatings.

Of all the different prior art deposition processes, HVOF yields the most dense erosion resistant coatings and as such, is generally preferred for forming erosion resistant coatings. However, even HVOF yields coatings with high residual stress, which limits the coating thickness to about 500 microns (0.020 inches) in thickness. Also, because of the gas constituents used in the HVOF process and resulting particle temperature and velocity, the so-formed coatings generally contain high degrees of decarburization, which significantly reduces the coating erosion resistance.

Preparation of erosion resistant coatings must also account for fatigue effects that can occur in the coating. The fatigue effects of a coating have often been related to the strain-to-fracture (STF) of the coating, i.e., the extent to which a coating can be stretched without cracking. STF has, in part, been related to the residual stress in a coating. Residual tensile stresses reduce the added external tensile stress that must be imposed on the coating to crack it, while residual compressive stresses increase the added tensile stress that must be imposed on the coating to crack it. Typically, the higher the STF of the coating, the less of a negative effect the coating will have on the fatigue characteristics of the substrate. This is true because a crack in a well-bonded coating may propagate into the substrate, initiating a fatigue-related crack and ultimately cause a fatigue failure. Unfortunately, most thermal spray coatings have very limited STF, even if the coatings are made from pure metals, which would normally be expected to be very ductile and subject to plastic deformation rather than prone to cracking. Moreover, it is noted that thermal spray coatings produced with low or moderate particle velocities during deposition typically have a residual tensile stress that can lead to cracking or spalling of the coating if the thickness becomes excessive. Residual tensile stresses also usually lead to a reduction in the fatigue properties of the coated component by reducing the STF of the coating. Some coatings made with high particle velocities can have moderate to highly compressive residual stresses. This is especially true of tungsten carbide based coatings. Although high compressive stresses can beneficially affect the fatigue characteristics of the coated component, high compressive stresses can, however, lead to chipping of the coating when trying to coat sharp edges or similar geometric shapes.

Accordingly, there remains a need in the art for improved coating methods and coating compositions that provide effective protection against erosion resistance, such as is required for hydroelectric turbine components. Improved coating methods and/or coating compositions on regions of hydroelectric turbine components desirably need coatings with a combination of high erosion resistance, low residual stresses, and higher thickness to provide a coating with long life and high erosion resistance in high silt concentration operating conditions.

BRIEF SUMMARY

Disclosed herein are erosion resistant coatings and processes, which are especially suitable for coating hydroelectric turbine components that are exposed to silt during operation thereof. In one embodiment, the erosion resistant coating comprises a matrix comprising cobalt chromium and a plurality of tungsten carbide grains embedded in the cobalt chromium matrix, wherein the grains are less than about 2 microns in diameter, wherein the cobalt is at about 4 to about 12 weight percent, and the chromium is at about 2 to about 5 weight percent, wherein the weight percents are based on a total weight of the coating.

A hydroelectric turbine component exposed to silt particles during operation thereof comprises an erosion resistant coating on a surface of the hydroelectric turbine component formed by a high velocity air fuel process, the erosion resistant coating comprising a matrix comprising cobalt chromium, wherein the cobalt is at about 4 to about 12 weight percent, and the chromium is at about 2 to about 5 weight percent, wherein the weight percents are based on a total weight of the coating, and a plurality of tungsten carbide grains embedded in the cobalt chromium matrix, wherein the grains are less than about 2 microns in diameter.

In yet another embodiment, a hydroelectric turbine component having surfaces exposed to silt particles during operation thereof, and are provided with an erosion resistant coating formed by a high velocity air fuel process, the erosion resistant coating comprising a matrix comprising cobalt chromium, wherein the cobalt is at about 4 to about 12 weight percent, and the chromium is at about 2 to about 5 weight percent, wherein the weight percents are based on a total weight of the coating, and a plurality of tungsten carbide grains embedded in the cobalt chromium matrix, wherein the tungsten carbide grains are less than about 2 microns in diameter, and more preferably consisting of a mixture of carbide grains some with 2 microns or lower and most in the range of 0.3 microns to 1.0 microns in size.

A process for improving erosion resistance of a surface of a metal substrate, comprising thermally spraying a powder comprised of tungsten carbide and cobalt chromium by a high velocity air fuel process to form grains of the tungsten carbide in a cobalt chromium matrix, wherein the tungsten carbide grains are less than about 2 microns in diameter, wherein the cobalt is at about 4 to about 12 weight percent, and the chromium is at about 2 to about 5 weight percent, and wherein a total amount of the cobalt and the chromium is at about 6 to about 14 weight percent, wherein the weight percents are based on a total weight of the coating.

The above described and other features are exemplified by the following Figures and detailed description.

DETAILED DESCRIPTION

Figure 1:
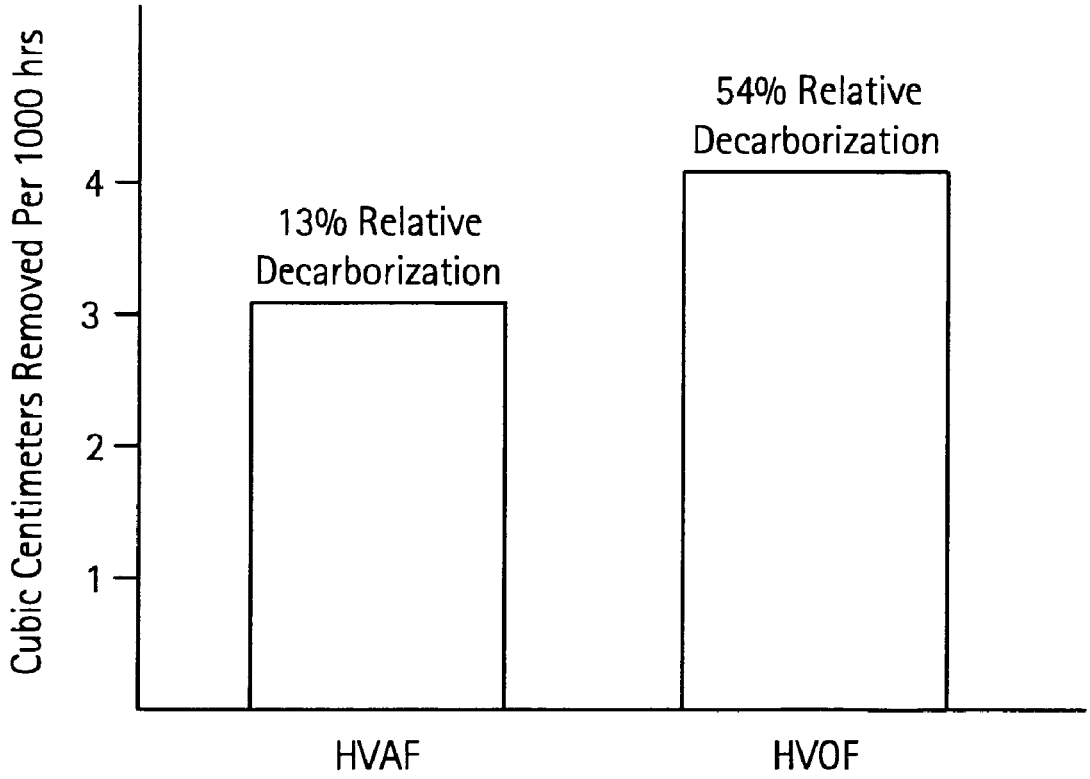
FIG. 1 graphically illustrates the erosion rate of various WC-CoCr coatings as a function of percent relative decarburization for HVAF and HVOF thermal spray processes for WCCoCr coatings.

Disclosed herein are coating compositions and coating methods that provide erosion resistance to components prone to silt erosion while simultaneously maintaining suitable corrosion resistance. In one embodiment, a high velocity air fuel (HVAF) process is employed for depositing erosion resistant coatings onto a component surface. The HVAF process is a material deposition process in which coatings are applied by exposing a substrate to a high-velocity jet at about 600 to about 800 m/s of about 5 to about 45 micron particles that are accelerated and heated by a supersonic jet of low-temperature "air-fuel gas" combustion products. The HVAF spraying process deposits an extremely dense (minimal porosity) and substantially non-oxidized coating. Moreover, increased thicknesses can be obtained relative to other thermal plasma spray processes, resulting in turbine components exhibiting superior erosion resistance properties. The HVAF process utilizes a fuel such as kerosene, propane, propylene, or the like, that is combusted with air as opposed to oxygen, which is used in the HVOF process. As a result, the thermally sprayed particulate feedstock is exposed to a lower temperature as compared to the HVOF process. Since the HVAF process ensures a high particle velocity of about 600 to about 800 meters per second (m/s) and a lower particle temperature, the coatings produced thereby have lower levels of oxidation and decarburization as well as lower residual stresses. In contrast, HVOF thermal spray processes employ higher temperatures of about 1,500 to about 2,200° C., which deleteriously results in oxidation and deterioration of spray material upon deposition of the coating. Because of the oxidation as well as a buildup of residual stresses caused by the process, maximum coating thicknesses is at about 500 microns for the HVOF process.

Robotic operation of the HVAF thermal spray gun is the preferred method to deposit the coating composition. The particles that form the coating are heated (not melted) and generate high kinetic energy due to the flame velocity. The particles splat out upon impact with the surface to be coated thereby forming a coating. The high velocity and lower temperatures employed reduce decarburization of primary carbides and enable thicker and denser coatings due to the lower residual stresses associated with the process. As such, high percentage primary carbide coatings can be applied at thicknesses that were previously unattainable, thereby providing improved life of coatings in erosion prone environments.

The HVAF process can advantageously be used to impart erosion resistance to those hydroelectric turbine components, or regions of components that are amenable to line of sight thermally sprayed coating processes. Thicknesses in excess of 500 microns have been obtained, and these coatings advantageously exhibit low levels of decarburization and low residual stress. As such, the HVAF process as described herein can provide coating thicknesses on hydroelectric components that are suitable for prolonged exposure to silt environment. The HVAF process is advantageously positioned to produce coatings consisting of hard particulates embedded in metallic binder matrix. The hard particulates can include metallic oxides, metallic borides, metallic or silicon or boron nitrides and metallic or silicon or boron carbides, or diamond. The metallic binder can consist of ferrous alloys, nickel based alloys or cobalt-based alloys. Advantageously, the HVAF process provides: a) high velocity during spraying that results in a dense well bonded coating; b) high velocity and lower flame temperatures resulting in a coating with low thermal degradation of the hard phase, and limited dissolution of the hard phase which produces coatings with the desired high "primary" hard phase content for better erosion resistance and better toughness; c) coatings with low residual stresses because of lower flame temperature; and d) coatings with high thickness because of lower residual stresses. Typically, when HVOF carbide coatings are sprayed to thicknesses in excess of 500 microns, cracking and/or spalling is observed because of residual stress in the coating. In contrast, HVAF coatings can achieve greater thickness without residual stress, thus forming coatings free from cracking, spalling and debonding. The combination of high primary hard phase content and high thickness makes HVAF coatings eminently suitable for erosion resistance applications in hydroelectric turbines. As noted in the background section, prior art process generally relied on HVOF technology, which is limited to maximum thicknesses of about 500 microns. In contrast, the use of the HVAF process described herein can provide coating thicknesses in excess of 500 microns, with thicknesses greater than about 2,000 microns attainable, thereby providing erosion resistant coatings that can withstand prolonged contact in silt containing environments. For hydroelectric turbine components, the coating is preferably at least about 500 microns in thickness, with greater than 1,000 microns more preferred, and with greater than about 2,000 microns even more preferred.

As an example, nanostructured grains of tungsten carbide and/or submicron sized grains of (WC) were embedded into a cobalt chromium (CoCr) binder matrix. This particular erosion resistant coating was applied by an HVAF deposition of a powdered blend of the coating constituents. The cobalt plus chromium was combined with the tungsten carbide in a spray-dried and sintered process. Alternatively, a sintered and crushed powder with most of the cobalt chromium still present as metals can be used. They may also be combined with the carbide in a cast and crushed powder with some of the cobalt chromium reacted with the carbide. When thermally sprayed by the HVAF process, these materials may be deposited in a variety of compositions and crystallographic forms. As used herein, the terms tungsten carbide (WC) shall mean any of the crystallographic or compositional forms of tungsten carbide.

Preferably, the HVAF process is employed to deposit a coating composition comprising Co in an amount by weight percent of about 4 to about 12, and Cr in an amount by weight percent of about 2 to about 5 weight percent, with the balance being WC. Also preferred is a total CoCr content from about 6 to about 14 weight percent, with the balance being WC. The presence of Cr has been found to limit the dissolution of primary WC during the HVAF spraying process and ensure higher retention of the primary WC phase. It is well known that higher primary WC results in better erosion resistance. The relatively lower amounts of CoCr compared to prior art compositions, has been found to reduce the mean free distance between WC grains, which promotes erosion resistance. It has been found that the nanosized and/or micron sized WC grains generally did not crack and did not raise stress levels in the surrounding metal CoCr binder. Moreover, the WC grains improved erosion resistance at shallow angles and when cracking was present, resulted in a more tortuous path, thereby providing longer life to the coating. The size of the WC grains is preferably less than about 2 microns, with about 0.3 to about 2 microns more preferred, and with about 0.4 to about 1 micron even more preferred. The use of the HVAF process to form the WCCoCr coating ensures minimal decomposition, dissolution, or oxidation of the WC particles and ensures coatings with high primary WC content. As such, relative to HVOF processes, decarburization is significantly decreased.

Figure 2:
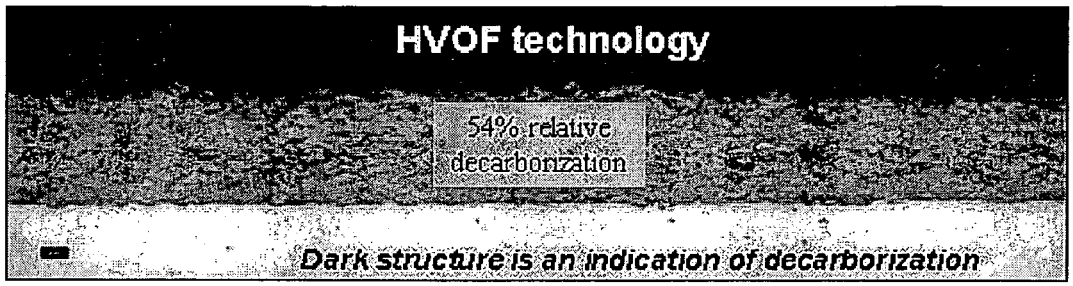
FIG. 2 are metallographic cross sections of WC10Co4Cr coatings made by HVOF and HVAF processes and illustrating the relative amounts of decarburization that occur from each respective process.
Figure 2:
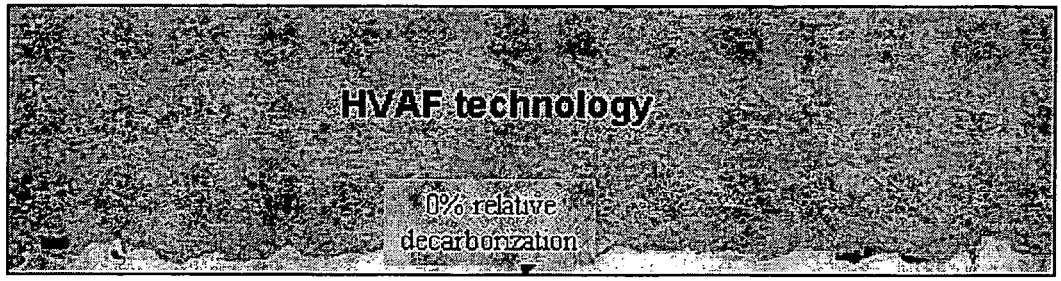
Figure 3:
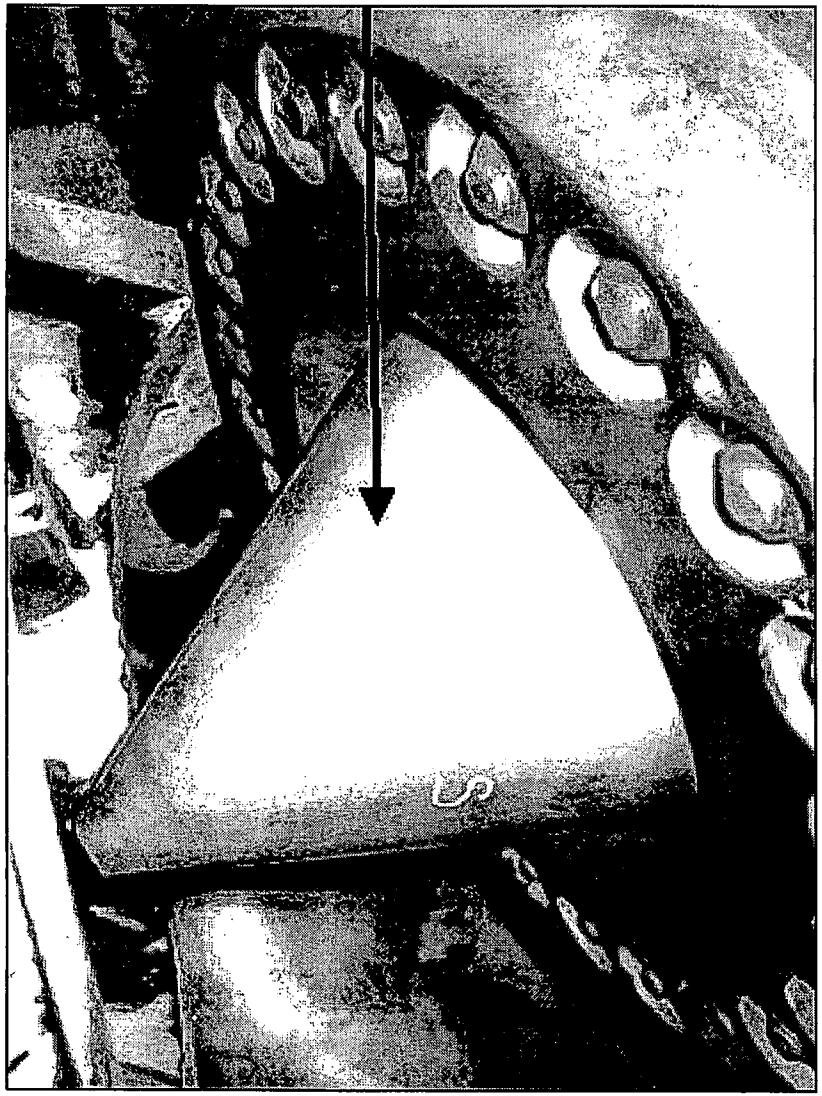
FIG. 3 shows a needle from a Pelton hydroturbine with an HVAF applied WCCoCr coating.

FIGS. 1 and 2 graphically and pictorially illustrate a comparison of a WCCoCr coating made by the HVAF and HVOF thermal spray processes. The amount removed by erosion for the HVAF coating was significantly less than the amount removed for the HVOF coating. Moreover, the HVAF coating exhibited 13% decarburization compared to 54% decarburization produced in the HVOF coating. These surprising results clearly show the advantages of the HVAF process relative to the HVOF process. In FIG. 2, both samples were etched to highlight areas of decarburization resulting from the respective processes. The darker and non-uniform structure shown in the HVOF coating is an indication of high levels of decarburization. In contrast, the coating produced by HVAF exhibited a uniform structure with no decarburization. HVOF is also limited to coating thicknesses of about 0.5 millimeters. FIG. 3 pictorially illustrates a Pelton needle coated with WCCoCr using the HVAF to produce a thickness of about 1.5 millimeters. The Pelton needle was field tested thermal spray process for a period of about 2,360 hours and exposed to about 10,000 tons of sand. No significant erosion was evident.

Figure 4:
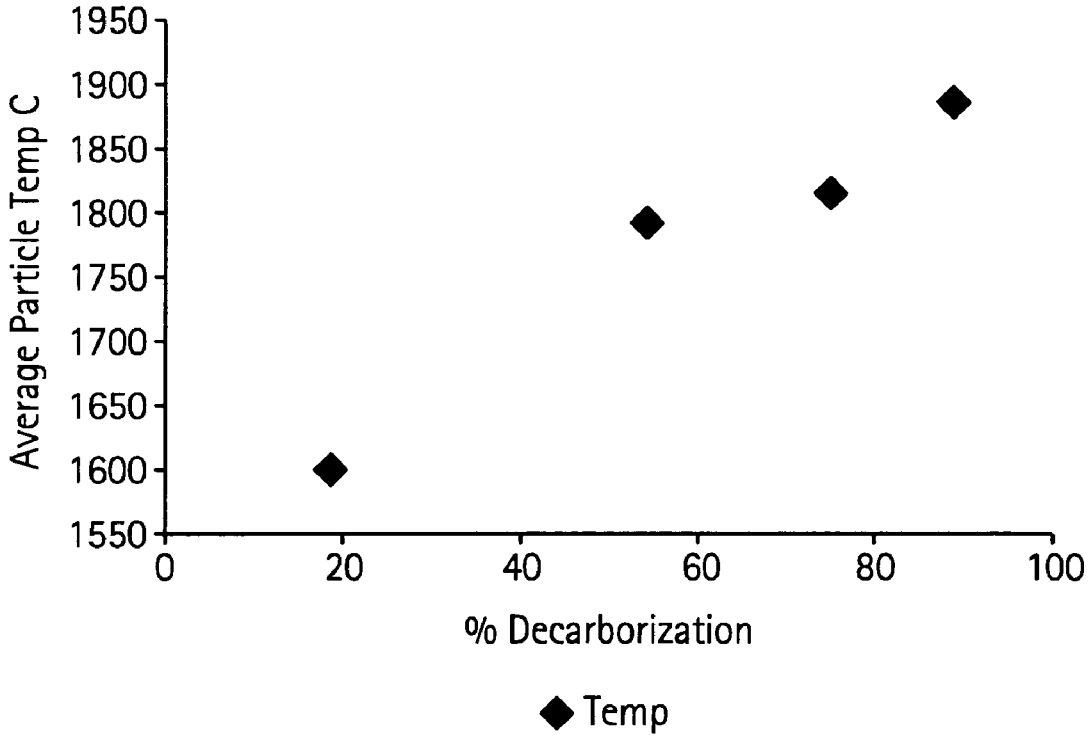
FIG. 4 graphically illustrates particle temperature as a function of % decarburization using an HVOF process for thermally spraying a WCCoCr coating.
Figure 5:
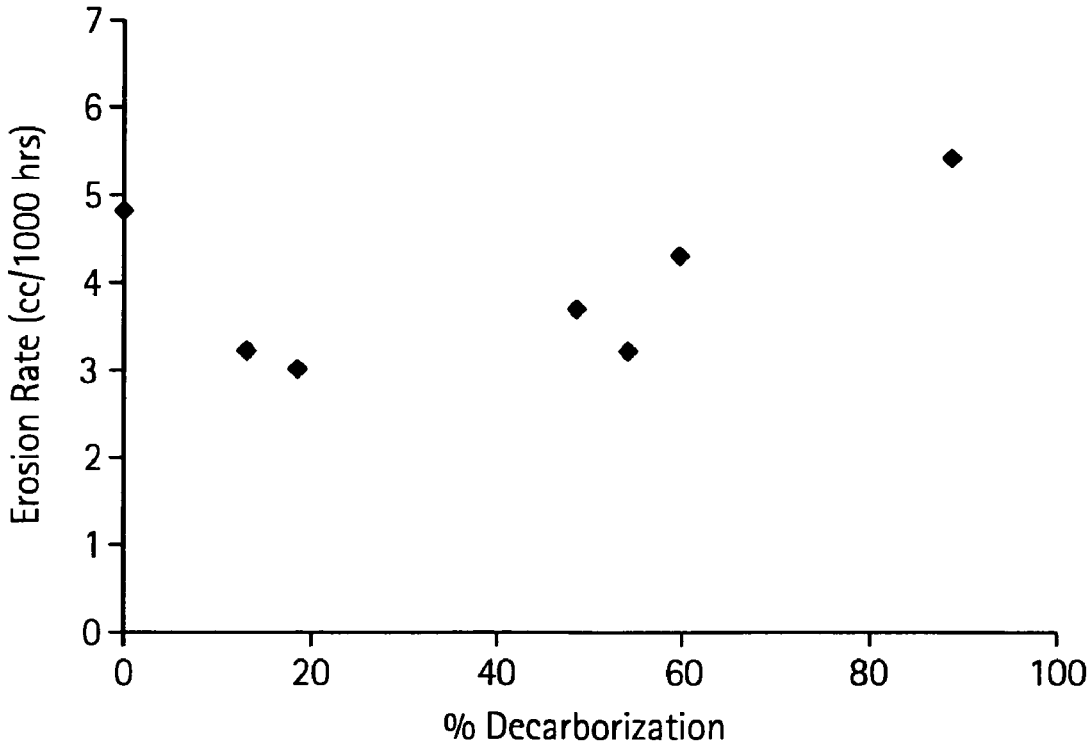
FIG. 5 graphically illustrates erosion rate as a function of % decarburization for a thermally sprayed HVOF coating of WCCoCr.

FIG. 4 graphically illustrates particle temperature as a function of % decarburization using an HVOF process for thermally spraying a WCCoCr coating. As particle temperature was decreased during the thermal spray process, percent decarburization also decreased. FIG. 5 graphically illustrates erosion rate as a function of % decarburization for a thermally sprayed HVOF coating of WCCoCr. The erosion rate was observed to decrease as a function of % decarburization.

Coating by HVAF generally comprises use of a feed powder having the desired composition. For example, blending a WC-CoCr powder is usually done in the powder form prior to loading it into the powder dispenser of the thermal spray deposition system. It may, however, be done by using a separate powder dispenser for each of the constituents and feeding each at an appropriate rate to achieve the desired composition in the coating. If this method is used, the powders may be injected into the thermal spray device upstream of the nozzle, through the nozzle, or into the effluent downstream of the nozzle. The preferred conditions for WCCoCr powder includes a powder size of about 5 to about 35 microns and a spray deposition temperature below about 1,600° C. (see FIG. 4) so as to substantially prevent decarburization but also have enough kinetic energy to splat out the powder particle and weld it to the previous coating layer, i.e., substrate. Thermal spray deposition processes that generate a sufficient powder velocity (generally greater than about 600 meters/second) and have average particle temperatures between about 1,500° C. to about 1,600° C. (for this powder and size) should achieve a well-bonded, dense coating microstructure with low decarburization and high cohesive strength can be used to produce these erosion resistant coatings. Once the particles reach a temperature where it is molten or in a softened state, a higher velocity generally results in coatings exhibiting improved cohesion and lower porosity.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

The invention claimed is:

1. A hydroelectric turbine component having a coating, compnsing:

a matrix comprising cobalt chromium, wherein the cobalt is at about 4 to about 12 weight percent, and the chromium is at about 2 to about 5 weight percent, wherein the weight percents are based on a total weight of the coating; and a plurality of tungsten carbide grains embedded in the cobalt chromium matrix, wherein the grains are less than about 2 microns in diameter, wherein the coating is deposited by a high velocity air fuel process utilizing a fuel combusted in air.

2. The hydroelectric turbine component of claim 1, wherein the plurality of tungsten carbide grains have the diameter of about 0.4 to about 1 micron.

3. The hydroelectric turbine component of claim 1, wherein the coating has a thickness greater than about 500 microns.

4. A hydroelectric turbine component exposed to silt particles during operation thereof, the hydroelectric turbine component comprising:

an erosion resistant coating on a surface of the hydroelectric turbine component formed by a high velocity air fuel process, the erosion resistant coating comprising a matrix comprising cobalt chromium, wherein the cobalt is at about 4 to about 12 weight percent, and the chromium is at about 2 to about 5 weight percent, wherein the weight percents are based on a total weight of the coating, and a plurality of tungsten carbide grains embedded in the cobalt chromium matrix, wherein the grains are less than about 2 microns in diameter.

5. The hydroelectric turbine component of claim 4, wherein the cobalt and the chromium provide a total amount of about 6 to about 14 weight percent, based on the total weight of the coating.

6. The hydroelectric turbine component of claim 4, wherein the hydroelectric turbine components comprises Francis runners, Francis guide vanes, Francis check plates, Francis rotating and stationary seals, Francis draft tube, Pelton needles, Pelton seats, Pelton beaks, Kaplan blades and Kaplan discharge rings.

7. The hydroelectric turbine comDonent of claim 4, wherein the plurality of tungsten carbide grains have the diameter of about 0.4 to about 1 micron.

8. The hydroelectric turbine component of claim 4, wherein the erosion resistant coating has a thickness greater than about 500 microns.

* * * * *

UNITED STATES PATENT AND TRADEMARK OFFICE

CERTIFICATE OF CORRECTION

PATENT NO. : 7,431,566 B2
APPLICATION NO. : 11/546861
DATED : October 7, 2008
INVENTOR(S) : Gray et al.

It is certified that error appears in the above-identified patent and that said Letters Patent is hereby corrected as shown below:

In Column 7, Line 6, in Claim 1, delete “compnsing:” and insert -- comprising: --, therefor.

In Column 8, Line 20, in Claim 7, delete “comDonent” and insert -- component --, therefor.

Signed and Sealed this

Thirty-first Day of March, 2009

John Doll

JOHN DOLL
*Acting Director of the United States Patent and Trademark Office*